US010190558B2

(12) United States Patent
Noguchi

(10) Patent No.: US 10,190,558 B2
(45) Date of Patent: Jan. 29, 2019

(54) FUEL INJECTION DEVICE NOZZLE PLATE

(71) Applicant: ENPLAS CORPORATION, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 0 days.

(21) Appl. No.: 15/123,096

(22) PCT Filed: Feb. 3, 2015

(86) PCT No.: PCT/JP2015/052899
§ 371 (c)(1),
(2) Date: Sep. 1, 2016

(87) PCT Pub. No.: WO2015/133213
PCT Pub. Date: Sep. 11, 2015

(65) Prior Publication Data

US 2017/0067431 A1 Mar. 9, 2017

(30) Foreign Application Priority Data

Mar. 7, 2014 (JP) ..... 2014-045250

(51) Int. Cl.
*F02M 61/18* (2006.01)

(52) U.S. Cl.
CPC ..... *F02M 61/1853* (2013.01); *F02M 61/184* (2013.01); *F02M 61/1826* (2013.01)

(58) Field of Classification Search
CPC ..... F02M 61/18; F02M 61/1806; F02M 61/1826; F02M 61/184; F02M 61/1846; F02M 61/1853
See application file for complete search history.

(56) References Cited

U.S. PATENT DOCUMENTS 4,732,327 A * 3/1988 Aichele ..... F02M 51/061 239/463
5,244,154 A 9/1993 Buchholz et al.
7,124,735 B2 * 10/2006 Kobayashi ..... F02M 51/0671 123/305

FOREIGN PATENT DOCUMENTS

| | | |
|---|---|---|
| JP | 4-303172 | 10/1992 |
| JP | 2003-314286 | 11/2003 |
| JP | 2004-190563 | 7/2004 |
| JP | 2013-194624 | 9/2013 |

OTHER PUBLICATIONS

International Search Report dated Apr. 28, 2015 in International (PCT) Application No. PCT/JP2015/052899.

* cited by examiner

*Primary Examiner* — Christopher Kim
(74) *Attorney, Agent, or Firm* — Wenderoth, Lind & Ponack, L.L.P.

(57) ABSTRACT

A nozzle plate to be attached to a fuel injection port of a fuel injection device has, in a nozzle plate main body, a nozzle hole through which fuel injected from the fuel injection port passes. A spray direction change element colliding with fuel spray injected from the nozzle hole and changing the travel direction of the fuel spray is integrally formed near an outlet of the nozzle hole of the nozzle plate main body. Accordingly, the travel direction of spray is determined by the spray direction change element according to the shape of the intake pipe, the position of an intake port, and the like.

18 Claims, 13 Drawing Sheets

FUEL INJECTION DEVICE NOZZLE PLATE

BACKGROUND OF THE INVENTION

The present invention relates to a fuel injection device nozzle plate, which is to be attached to the fuel injection port of a fuel injection device. The nozzle plate atomizes and injects fuel flowing from the fuel injection port.

BACKGROUND ART

An internal combustion engine (abbreviated below as an engine) of an automobile or the like mixes fuel injected from a fuel injection device and air introduced via an intake pipe to generate a combustible gas mixture and burns the combustible gas mixture in the cylinder. It is known that the mixture state of fuel injected from the fuel injection device and air significantly affects the performance of this type of engine and, in particular, the atomization of fuel injected from the fuel injection device is an important factor governing the performance of the engine. Therefore, a fuel injection device nozzle plate (abbreviated below as a "nozzle plate" as appropriate) for atomization of fuel is to be attached to the front end of the fuel injection device.

FIG. 13 illustrates the state of a fuel injection device 100 for a 4-valve cylinder (see FIG. 13A) and a nozzle plate 101 attached to the front end of the fuel injection device 100 (see FIGS. 13B and 13C). As illustrated in FIG. 13A, the fuel injection device 100 for a 4-valve cylinder sprays fuel from two nozzle holes 104 and 104 of the nozzle plate into the intake pipes 103 and 103 branching toward two intake ports 102 and 102 of the cylinder. However, in the fuel injection device 100 illustrated in FIG. 13, when fuel is injected from the two nozzle holes 104 and 104, spray 105 from the nozzle holes 104 and 104 is formed in cones. The cones of the spray 105 overlap each other and fuel fine particles in the overlapping spray 105*a* adhere to the wall surface of a branch section 106 of the intake pipes 103 and 103, thereby reducing the fuel economy.

FIG. 14 illustrates the state of the fuel injection device 100 devised to solve the above-noted problem (see FIG. 14A), and the nozzle plate 101 attached to the front end of the fuel injection device 100 (see FIGS. 14B and 14C). In the fuel injection device 100, a partitioning projection (convex wall) 107 is formed between the pair of nozzle holes 104 and 104 on the front surface (surface facing the inside of the intake pipe 103) of the nozzle plate 101 to limit the spread of the spray 105 from the nozzle holes 104, prevents the spray 105 from the nozzle holes 104 from overlapping, and prevents the spray 105 from adhering to the wall surface of the branch section 106 of the intake pipes 103 and 103 (see PTL 1).

CITATION LIST

Patent Literature

PTL 1: JP-A-2013-194624

The fuel injection device 100 illustrated in FIG. 14 limits the range of the spray 105, but it does not change the travel direction of the spray 105. Accordingly, the travel direction of the spray 105 cannot be determined according to the shape of the intake pipes 103, so fuel fine particles in the spray 105 adhere to wall surfaces and the like other than the wall surface of the branch section 106 of the intake pipe 103.

SUMMARY OF THE INVENTION

Therefore, an object of the invention is to provide a fuel injection device nozzle plate that can reduce the amount of fuel fine particles adhering to the wall surface of the intake pipe and the like by providing an integral spray direction change element for changing the travel direction of spray.

As illustrated in FIG. 1 to FIG. 12, the invention relates to a fuel injection device nozzle plate 7 having a nozzle hole 12. The nozzle plate 7 is attached to a fuel injection port 8 of a fuel injection device 1, and fuel injected from the fuel injection port 8 passes through the nozzle plate 7. In the invention, the nozzle hole 12 is formed in a nozzle plate main body 14. A spray direction change element 18 colliding with fuel spray injected from the nozzle hole 12 and changing the travel direction of the fuel spray is integrally formed near an outlet 15 of the nozzle hole 12 of the nozzle plate main body 14.

According to the invention, the travel direction of spray can be determined by the spray direction change element according to the shape of the intake pipe, the position of the intake port, and the like. Therefore, the amount of fine fuel particles adhering to the branch section of an intake pipe, the wall surface of the intake pipe, and the like can be reduced, and fuel droplets in the spray can be atomized, so the energy efficiency of an engine can be improved.

BRIEF DESCRIPTION OF THE DRAWINGS

FIGS. 2A and 2B illustrate the front end side of the fuel injection device provided with the fuel injection device nozzle plate according to the first embodiment of the invention, in which FIG. 2A is a vertical cross sectional view (cross sectional view taken along line A1-A1 in FIG. 2) illustrating the front end side of the fuel injection device, and FIG. 2B is a bottom view (diagram illustrating the front end surface of the fuel injection device seen from direction B1 in FIG. 2A) illustrating the front end side of the fuel injection device.

FIGS. 3A-3C illustrate the fuel injection device nozzle plate according to the first embodiment of the invention, in which FIG. 3A is a front view illustrating the nozzle plate, FIG. 3B is a cross sectional view illustrating the nozzle plate taken along line A2-A2 in FIG. 3A, and FIG. 3C is a back view illustrating the nozzle plate.

FIGS. 5A and 5B are structural diagrams illustrating an injection molding die used for injection molding of the fuel injection device nozzle plate, in which FIG. 5A is a vertical cross sectional view illustrating the injection molding die, and FIG. 5B illustrates the cavity inner plane of a first die in plan view.

FIGS. 6A and 6B illustrate a fuel injection device nozzle plate according to a second embodiment of the invention and this drawing corresponds to FIG. 4, in which FIG. 6A is an enlarged view (plan view) illustrating a part of the nozzle plate and FIG. 6B is an enlarged cross sectional view illustrating a part of the nozzle plate taken along line A4-A4 in FIG. 6A.

FIGS. 7A and 7B illustrate a fuel injection device nozzle plate according to a third embodiment of the invention and this drawing corresponds to FIG. 4, in which FIG. 7A is an enlarged view (plan view) illustrating a part of the nozzle plate, and FIG. 7B is an enlarged cross sectional view illustrating a part of the nozzle plate taken along line A5-A5 in FIG. 7A.

FIGS. 8A and 8B illustrate a fuel injection device nozzle plate according to a fourth embodiment of the invention and this drawing corresponds to FIG. 4, in which FIG. 8A is an enlarged view (plan view) illustrating a part of the nozzle plate, and FIG. 8B is an enlarged cross sectional view illustrating a part of the nozzle plate taken along line A6-A6 in FIG. 8A.

FIGS. 9A and 9B illustrate a fuel injection device nozzle plate according to a fifth embodiment of the invention and this drawing corresponds to FIG. 4, in which FIG. 9A is an enlarged view (plan view) illustrating a part of the nozzle plate, and FIG. 9B is an enlarged cross sectional view illustrating a part of the nozzle plate taken along line A7-A7 in FIG. 9A.

FIGS. 12A and 12B illustrate a fuel injection device nozzle plate according to an eighth embodiment of the invention and this drawing corresponds to FIG. 4, in which FIG. 12A is an enlarged view (plan view) illustrating a part of the nozzle plate, and FIG. 12B is an enlarged cross sectional view illustrating a part of the nozzle plate taken along line A8-A8 in FIG. 12A.

FIGS. 13A though 13C show a conventional fuel injection device, in which FIG. 13A illustrates the use state of a fuel injection device according to a conventional example for a 4-valve cylinder and illustrates the defect occurrence state of the conventional example.

FIGS. 14A through 14C illustrate a convention fuel injection device, in which FIG. 14A illustrates the use state of a fuel injection device according to a modified conventional example for a 4-valve cylinder, FIG. 14B is a cross sectional view illustrating a nozzle plate used in the fuel injection device in FIG. 14A, and FIG. 14C is a perspective view illustrating the appearance of the nozzle plate used in the fuel injection device in FIG. 14A.

DETAILED DESCRIPTION OF THE INVENTION

Embodiments of the invention will be described in detail below with reference to the drawings.

Figure 1:
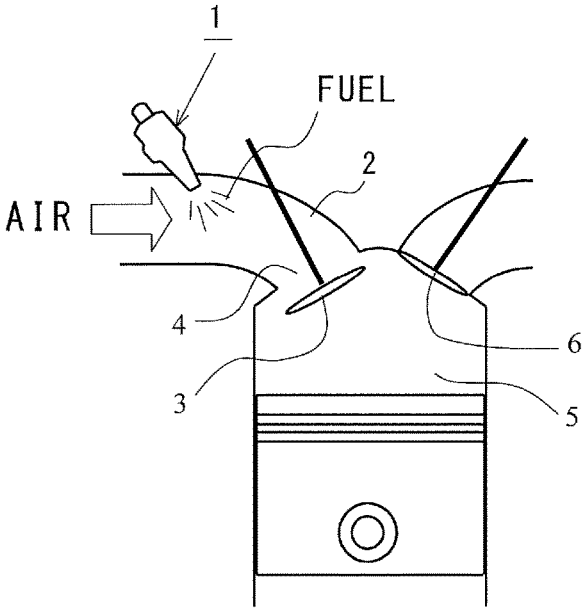
FIG. 1 schematically illustrates the state of a fuel injection device provided with a fuel injection device nozzle plate according to a first embodiment of the invention.

FIG. 1 schematically illustrates the state of a fuel injection device 1 provided with a fuel injection device nozzle plate according to the first embodiment. As illustrated in FIG. 1, the fuel injection device 1 of port injection type is installed at a midpoint of an intake pipe 2 of a 4-valve engine and injects fuel into the branch intake pipe 2 connected to two intake ports 4 when two intake valves 3 are opened, mixes the air introduced to the intake pipe 2 with the fuel, and supplies a combustible gas mixture from the intake port 4 to a cylinder 5. Note that FIG. 1 illustrates only one of the two intake valves 3 and only one of two exhaust valves 6.

Figure 2A:
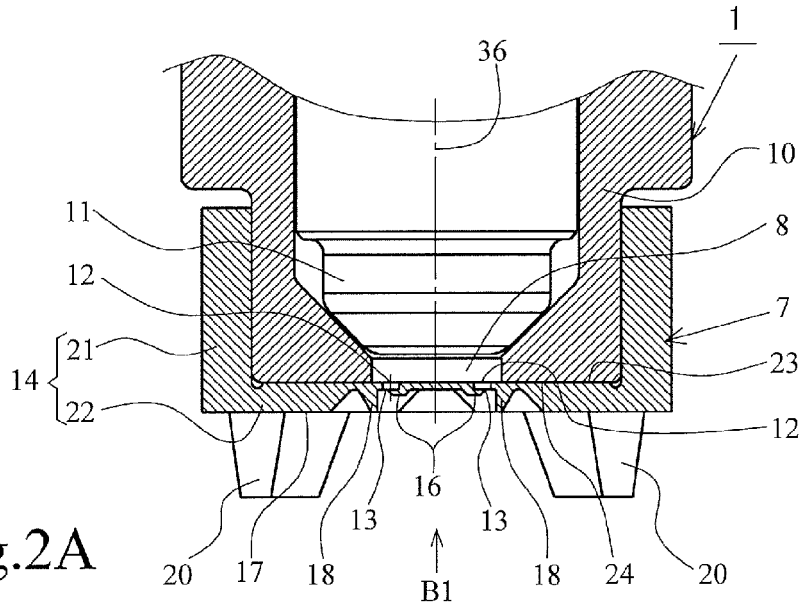
Figure 2B:
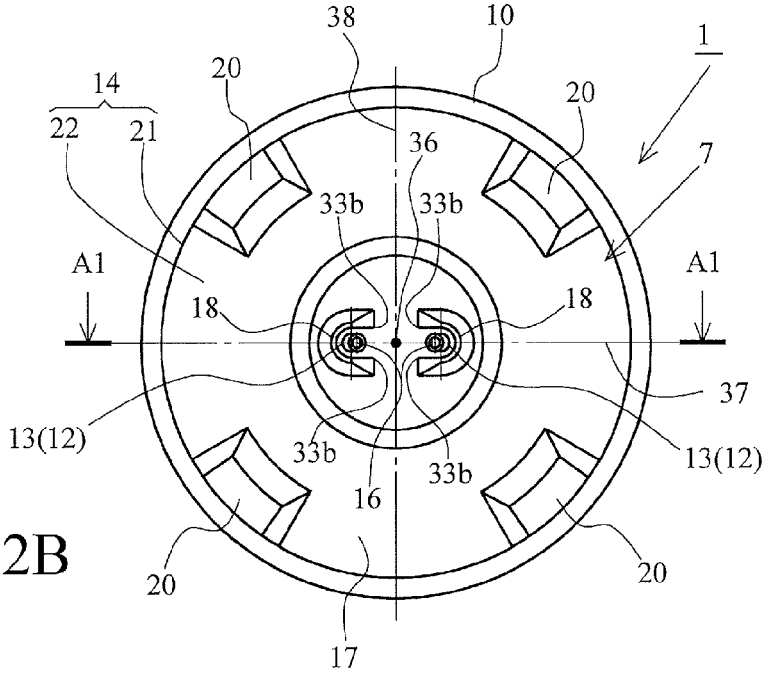

FIGS. 2A and 2B illustrate the front end side of the fuel injection device 1 provided with the fuel injection device nozzle plate 7 (referred to below as the nozzle plate). FIG. 2A is a vertical cross sectional view (cross sectional view taken along line A1-A1 in FIG. 2B) illustrating the front end side of the fuel injection device 1. In addition, FIG. 2B is a bottom view (diagram illustrating the front end surface of the fuel injection device 1 seen from the direction B1 in FIG. 2A) illustrating the front end side of the fuel injection device 1.

As illustrated in FIGS. 2A and 2B, the fuel injection device 1 has the nozzle plate 7 on the front end side of a valve body 10 in which the fuel injection port 8 is formed. In the fuel injection device 1, a needle valve 11 is opened or closed by a solenoid (not illustrated). When the needle valve 11 is opened, fuel in the valve body 10 is injected from the fuel injection port 8 and the fuel injected from the fuel injection port 8 is injected externally through the nozzle hole 12 and an orifice 13 of the nozzle plate 7.

Figure 3C:
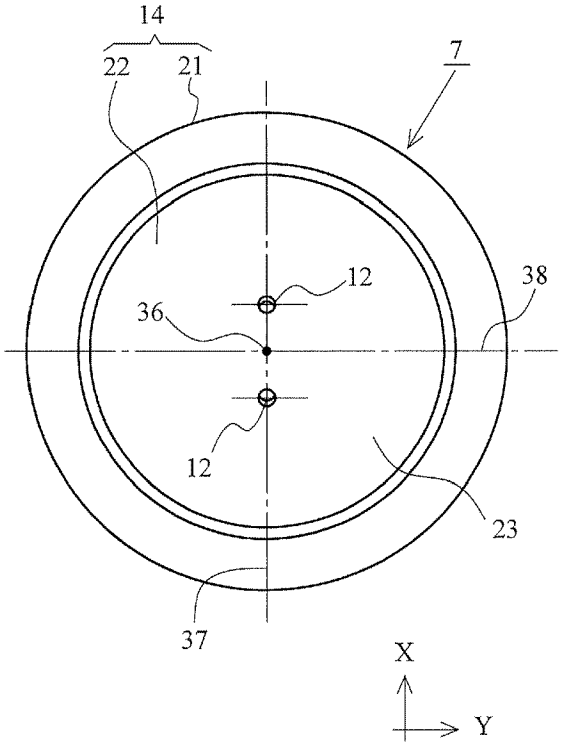
Figure 3B:
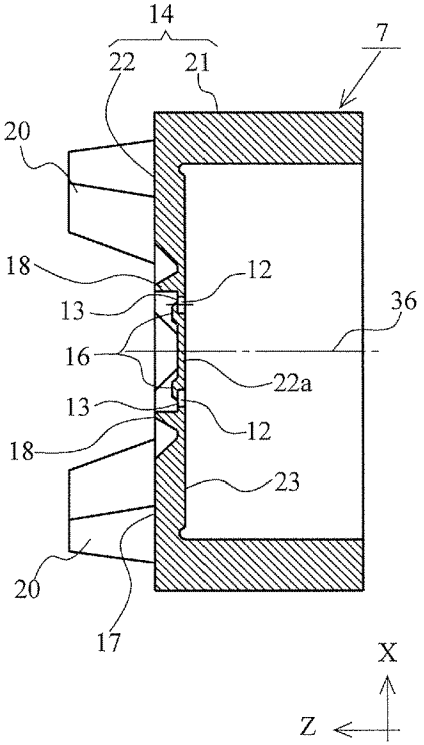
Figure 3A:
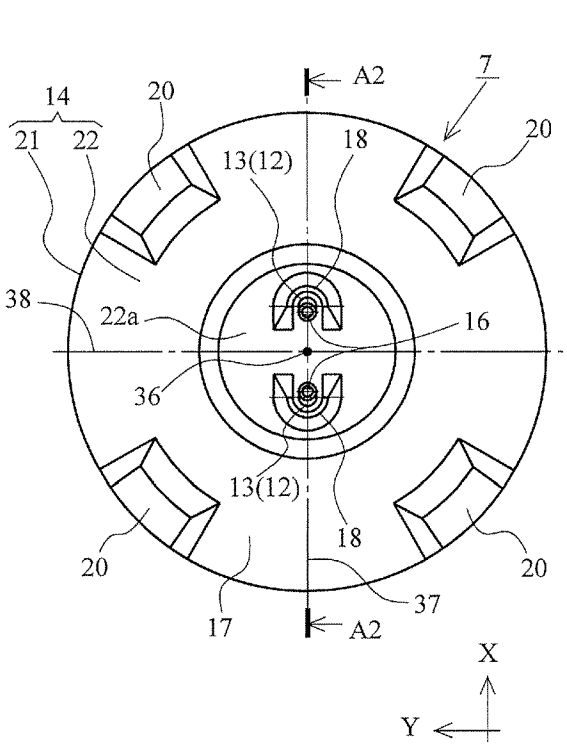
Figure 4A:
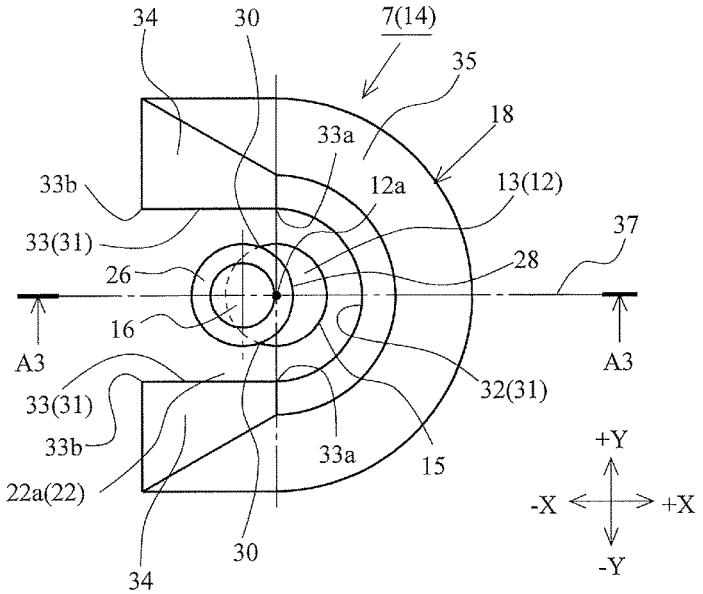
FIG. 4A is an enlarged view (plan view) illustrating a part of the nozzle plate in FIG. 3A.
Figure 4B:
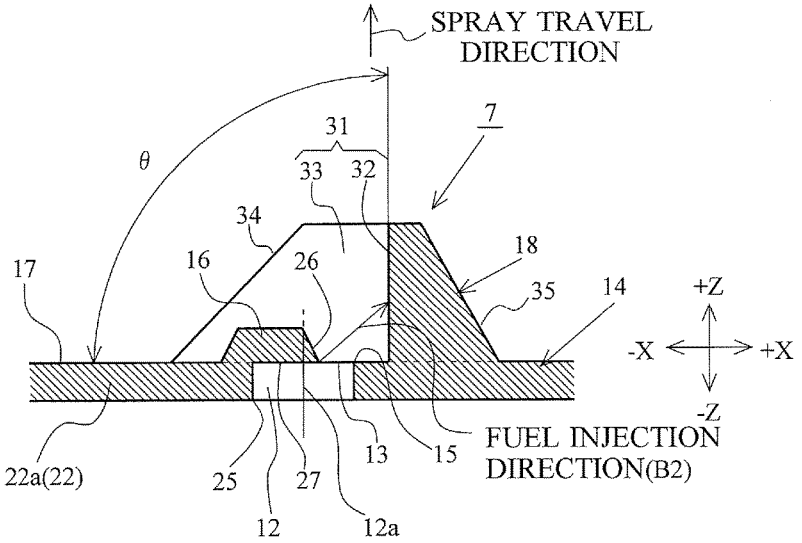
FIG. 4B is an enlarged cross sectional view illustrating a part of the nozzle plate taken along line A3-A3 in FIG. 4A.

FIGS. 3A-4B illustrate the nozzle plate 7 according to the embodiment. FIG. 3A is a front view illustrating the nozzle plate 7, FIG. 3B is a cross sectional view illustrating the nozzle plate 7 taken along line A2-A2 in FIG. 3A, and FIG. 3C is a back view illustrating the nozzle plate 7. In addition, FIG. 4A is an enlarged view (plan view) illustrating a part of the nozzle plate 7 in FIG. 3A, and FIG. 4B is an enlarged cross sectional view illustrating a part of the nozzle plate 7 taken along line A3-A3 in FIG. 4A.

As illustrated in FIG. 2A to FIG. 4B, the nozzle plate 7 integrally includes the nozzle plate main body 14 provided with the two nozzle holes 12, an interference body 16 partially blocking the outlets 15 of the nozzle holes 12 of the nozzle plate main body 14, a spray direction change element 18 positioned in the vicinity of the nozzle holes 12 on an outer plane 17 of the nozzle plate main body 14, and a plurality of protecting projections 20 protecting the nozzle holes 12 and the vicinity of the nozzle holes 12.

The nozzle plate main body 14 is a bottomed cylindrical body, made of a synthetic resin material (for example, PPS, PEEK, POM, PA, PES, PEI, or LCP), that includes a cylindrical wall part 21 and a bottom wall part 22 formed integrally with one end side of the cylindrical wall part 21. This nozzle plate main body 14 is fixed to the valve body 10 in a state in which the cylindrical wall part 21 is fitted onto the outer periphery of the front end side of the valve body 10 without any space and an inner surface 23 of the bottom wall part 22 abuts against a front end surface 24 of the valve body 10. In addition, the bottom wall part 22 of the nozzle plate main body 14 is provided with the plurality of (the pair of) nozzle holes 12 which allow the fuel injection port 8 of the valve body 10 to communicate with the outside. The nozzle holes 12 of the nozzle plate main body 14 are straight circular holes orthogonal to the inner surface 23 of the bottom wall part 22. The nozzle holes 12 introduce, from inlets 25 facing the fuel injection port 8 of the valve body 10, fuel injected from the fuel injection port 8 and injects, from the outlet 15 facing the outside, the fuel introduced from the inlets 25. In addition, in the nozzle plate main body 14, the shape of the opening edge of the outlet 15 of the nozzle hole 12 is circular. The nozzle hole 12 is formed in a thin-walled part 22*a* of the bottom wall part 22 formed by, for example, countersinking.

In addition, in the nozzle plate main body 14, the outlets 15 of the nozzle holes 12 are partially blocked by the interference bodies 16. The interference body 16 is formed in a truncated cone, the outer diameter is reduced from the outlet 15 of the nozzle hole 12 toward the +Z direction in FIG. 4B, and a side surface 26 is tapered. The side surface 26 of the interference body 16 crosses a fuel collision surface 27 with which a part of fuel passing through the nozzle hole 12 collides, at an acute angle. The fuel collision surface 27 of the interference body 16 and the outer surface 17 (the surface opposite to the inner surface 23) of the thin-walled part 22*a* of the bottom wall part 22 are present on a single plane (i.e., co-planar). In addition, the interference body 16 forms, at the outlet 15 of the nozzle hole 12, the orifice 13 that rapidly reduces the fuel flowing through the nozzle hole 12 by partially blocking the outlet 15 of the nozzle hole 12. As shown in FIG. 4A, the orifice 13 is crescent-shaped due to the opening edge of the outlet 15 of the nozzle hole 12 and a part (arc-shaped outer edge part) of a circular outer edge part 28 of the interference body 16. Both end parts of the orifice 13 are acute and sharp corner portions 30 without roundness.

The spray direction change element 18 is a projecting body projecting from the outer surface 17 of the thin-walled part 22*a*, and is formed in the vicinity of the outlet 15 of the nozzle hole 12 on the outer surface 17 of the thin-walled part 22*a* of the bottom wall part 22. The spray direction change element 18 has an inner wall surface 31 formed in a substantially U-shape in plan view (seen from the front side in FIG. 3A). The inner wall surface 31 includes the first inner wall surface part 32 and a pair of second inner wall surface parts 33 and 33. The first inner wall surface part 32 is a curved surface standing so as to partially surround the outlet 15 of the nozzle hole 12 and the pair of second inner wall surface parts 33 and 33 extend from both ends of the first inner wall surface part 32 so as to face each other. The first inner wall surface part 32 is a semicircular curved surface orthogonal to the outer surface 17 of the thin-walled part 22 and concentric with a center 12*a* of the nozzle hole 12, and the first inner wall surface part 32 is positioned so as to surround half (in the circumferential direction) of the outlet 15 of the nozzle hole 12. In addition, the second inner wall surface part 33 has one end part connected smoothly to an end part of the first inner wall surface part 32 and is disposed orthogonally to the outer surface 17 of the thin-walled part 22*a*. In addition, the first inner wall surface part 32 and the second inner wall surface parts 33 have dimensions allowing the collision of the entire fuel spray injected obliquely forward (direction B2 in FIG. 4B) from the orifice 13 (the opening of the outlet 15 of the nozzle hole 12) and change the travel direction of the fuel spray injected obliquely forward from the orifice 13 to a direction determined according to the shape of the intake pipe 2 and the position of the intake port 4. The pair of second inner wall surface parts 33 and 33 is disposed so that the other end parts are separated from each other. When fuel is injected from the orifice 13 and the pressure in the vicinity of the orifice 13 is reduced, the pair of second inner wall surface parts 33 and 33 also functions as air introduction element for guiding air around the spray direction change element 18 to the vicinity of the orifice 13 along the outer surface 17 of the thin-walled part 22*a*. The part of the second inner wall surface parts 33 not colliding with fuel spray injected from the orifice 13 is cut obliquely to form chamfered portions 34. In addition, the outer surface of the spray direction change element 18 is formed in an inclined plane 35 to facilitate the removal from the die during injection molding, which will be described later.

As illustrated in FIG. 2B and FIG. 3A, the pair of nozzle holes 12 and 12, the pair of interference bodies 16 and 16, and the pair of spray direction change elements 18 and 18 are positioned on the first center line 37 passing through a center (the central axis of the nozzle plate main body 14) 36 of the bottom wall part 22 line-symmetrically with respect to the first center line 37. In addition, the pair of nozzle holes 12 and 12, the pair of interference bodies 16 and 16, and the pair of spray direction change elements 18 and 18 are formed line-symmetrically with respect to the second center line 38 passing through the center 36 of the bottom wall part 22 orthogonally to the first center line 37 so that other end parts 33*b* and 33*b* close to the opening side of the second inner wall surface parts 33 and 33 face each other equidistantly from the second center line 38.

In addition, as illustrated in FIG. 2B and FIG. 3A, in the nozzle plate main body 14, the four protecting projections 20 projecting from the outer surface 17 of the bottom wall part 22 like blocks are formed at regular intervals along the outer peripheral edge of the bottom wall part 22. The protecting projections 20 can prevent attachment tools and the like from colliding with the nozzle hole 12 and the peripheral portion of the nozzle hole 12 and prevent the nozzle hole 12 and the peripheral portion of the nozzle hole 12 from being damaged by attachment tools and the like when the nozzle plate 7 is attached to the valve body 10 of the fuel injection device 1. In addition, the protecting projections 20 can prevent the peripheral components of the engine and the like from colliding with the nozzle hole 12 and the peripheral portion of the nozzle hole 12, and can prevent the nozzle hole 12 and the peripheral portion of the nozzle hole 12 from being damaged by peripheral components of the engine and the like when the fuel injection device 1 to which the nozzle plate 7 has been attached is installed at a midpoint of the intake pipe 2.

Figure 5A:
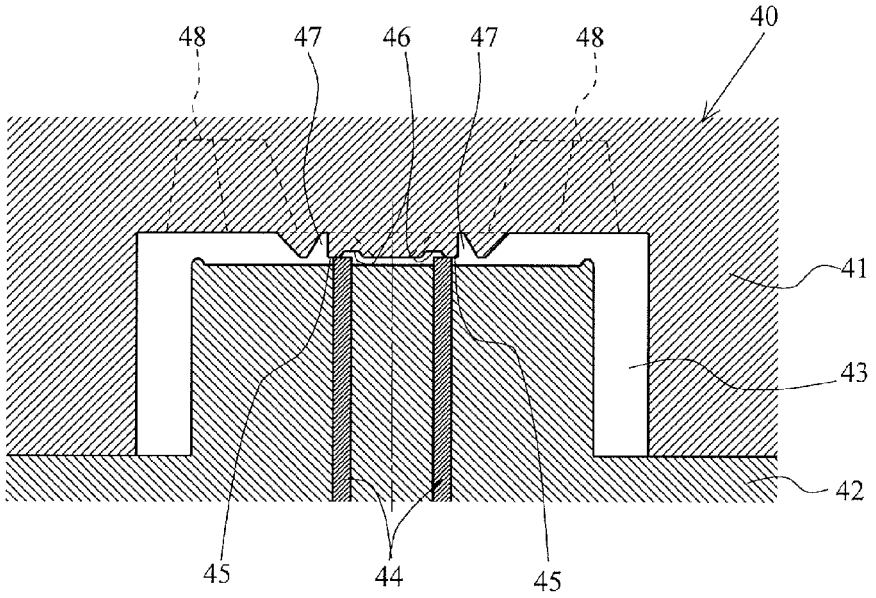
Figure 5B:
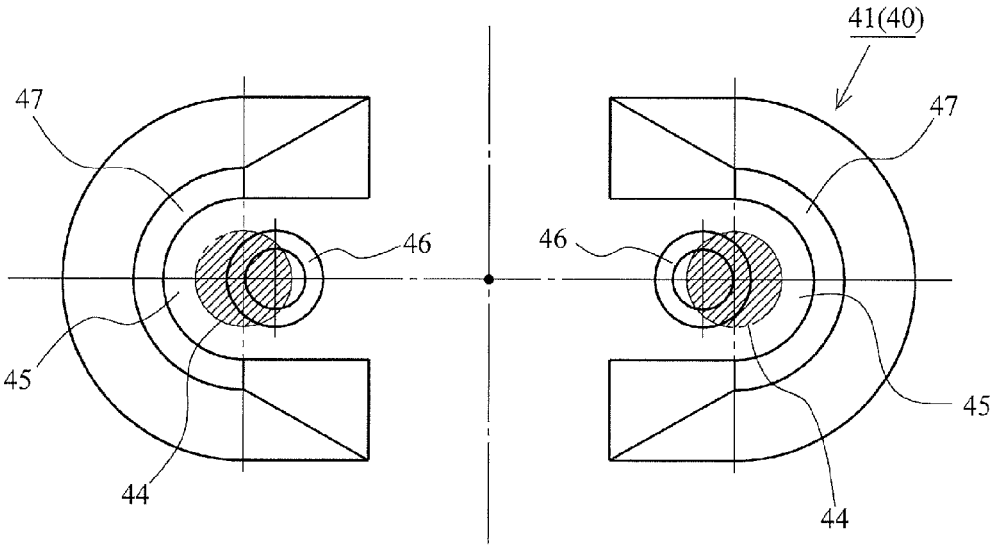

FIGS. 5A and 5B are structural diagrams illustrating an injection molding die 40 used for injection molding of the nozzle plate 7. As illustrated in FIG. 5, in an injection molding die 40, a cavity 43 is formed between the first die 41 and the second die 42 and nozzle hole formation pins 44 and 44 for forming the nozzle holes 12 and 12 project into the cavity 43. The tips of the nozzle hole formation pins 44 and 44 abut against a cavity inner plane 45 of the first die 41. Concave portions 46 and 46 for forming the interference bodies 16 and 16 are formed in the vicinity of the parts of the first die 41 against which the nozzle hole formation pins 44 and 44 abut. In addition, the first die 41 is provided with concave portions 47 and 47 for forming the spray direction change elements 18 and 18 and four concave portions 48 for forming the four protecting projections 20.

In this injection molding die 40, when molten resin is injected into the cavity 43 from a gate (not illustrated), the nozzle plate 7 in which the interference bodies 16, the spray direction change means 18, and the protecting projections 20 are formed integrally with the nozzle plate main body 14 is formed (see FIG. 2 and FIG. 3). In the nozzle plate 7 injection-molded using the injection molding die 40, the fuel collision surface 27 of the interference body 16 and the outer plane 17 of the bottom wall part 22 are present on a single plane and both end parts of the crescent orifice 13 are the acute corner portions 30 and 30 without roundness (see FIG. 4A). Since the nozzle plate 7 injection-molded in this way has a higher efficiency than a nozzle plate formed by etching or discharge machining, the product cost can be reduced.

In the nozzle plate 7 according to the embodiment described above, a part of fuel injected from the fuel injection port 8 of the fuel injection device 1 collides with the fuel collision surface 27 of the interference body 16 to undergo agitation. A flow of the fuel having undergone agitation moves toward the orifice 13 along the fuel collision surface 27, collides with a flow of fuel attempting to pass straight through the nozzle hole 12 and the orifice 13, and disturbs the flow of fuel attempting to pass straight through the nozzle hole 12 and the orifice 13. In addition, in the nozzle plate 7 according to the embodiment, both end parts of the orifice 13 are the acute corner portions 30 and 30 without roundness. As a result, in the nozzle plate 7 according to the embodiment, of the fuel injected from the orifice 13, the liquid film of the fuel injected from both corner portions 30 and 30 of the orifice 13 and their vicinity is made thin and acutely sharp, and the fuel injected from the corner portions 30 and 30 of the orifice 13 and their vicinity is easily atomized due to the friction with air in the vicinity of the orifice 13. In addition, in the nozzle plate 7 according to the embodiment, the opening edge of the orifice 13 is formed in a crescent tapered from the central part to both corner portions 30 and 30, so the opening edge of the orifice 13 is narrowed toward the corner portions 30 and 30. Accordingly, since the fuel discharged from the orifice 13 is formed in a thin film (like a curtain) following the shape of the opening edge of the orifice 13, the shape is further effective for atomization. Then, a flow (liquid flow) of fuel injected from the orifice 13 looses its pressure in a stroke, disrupts itself by obtaining the energy on the upstream side of the orifice 13, and changes to spray (fuel spray) having fine particles (droplets) of the atomized fuel. Then, the spray collides with the inner wall surface 31 of the spray direction change element 18 and droplets in the spray are further atomized. The travel direction of the spray having the droplets atomized by colliding with the inner wall surface 31 of the spray direction change element 18 is changed to a direction according to the shape of the intake pipe 2 and the position of the intake port 4 by the spray direction change element 18, thereby reducing the amount of fine particles of fuel adhering to the branch section of the intake pipe 2 and the wall surface of the intake pipe 2. Accordingly, the nozzle plate 7 according to the embodiment can improve the energy efficiency of an engine.

As described above, in the nozzle plate 7 according to the embodiment, the travel direction of spray can be determined by the spray direction change element 18 according to the shape of the intake pipe 2, the position of the intake port 4, and the like, the amount of fine fuel particles adhering to the branch section of the intake pipe 2, the wall surface of the intake pipe 2, and the like can be reduced, and fuel droplets in the spray can be atomized, so the energy efficiency of an engine can be improved.

As illustrated in FIG. 4B, in the nozzle plate 7 according to the embodiment, although angle θ formed by the inner wall surface 31 of the spray direction change element 18 and the outer surface 17 of the thin-walled part 22*a* is 90°, the travel direction of the spray can be changed to an appropriate direction by setting angle θ formed by the inner wall surface 31 of the spray direction change element 18 and the outer surface 17 of the thin-walled part 22*a* to an appropriate value according to the shape of the intake pipe 2, the position of the intake port 4, and the like.

In addition, changes in the travel direction of the spray in the embodiment means changes in the travel direction of the entire spray, not the partial limitation of the travel of the spray as in the conventional example.

Second Embodiment

Figure 6A:
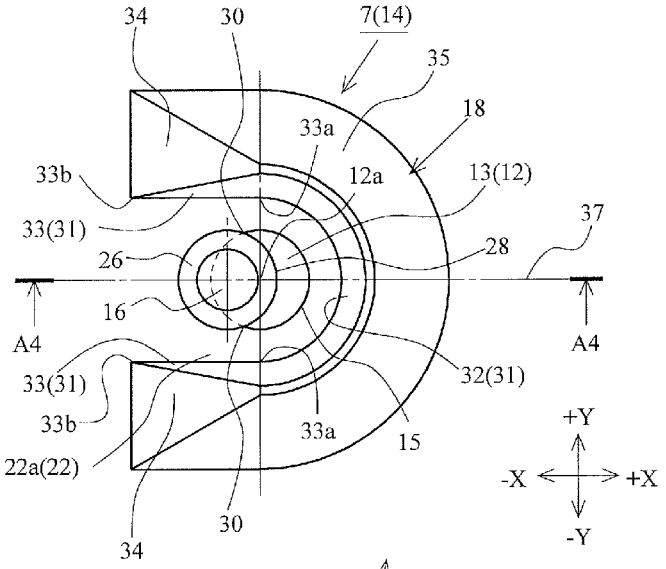
Figure 6B:
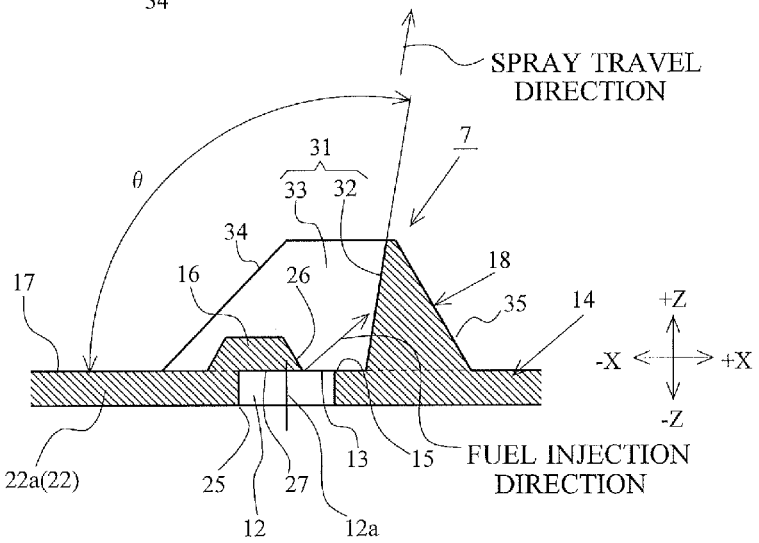

FIGS. 6A and 6B illustrate a part of the nozzle plate 7 according to the second embodiment of the invention and illustrates a first modification of the nozzle plate 7 according to the first embodiment. In the nozzle plate 7 according to the embodiment, the same components as in the nozzle plate 7 according to the first embodiment are given the same reference numerals to eliminate the same descriptions as in the nozzle plate 7 according to the first embodiment.

In the nozzle plate 7 according to the embodiment, the inner wall surface 31 of the spray direction change element 18 is an inclined plane and the inner wall surface 31 is opened in the normal direction (+Z direction in FIG. 6B) from the outer plane 17 of the thin-walled part 22*a*.

The nozzle plate 7 according to the embodiment described above can make spray injected from the orifice 13 collide with the inner wall surface 31 of the spray direction change element 18 and change the travel direction of the spray having collided with the inner wall surface 31 of the spray direction change means 18 to the direction along the inner wall surface 31, so the same effects as in the nozzle plate 7 according to the first embodiment can be obtained.

Third Embodiment

Figure 7A:
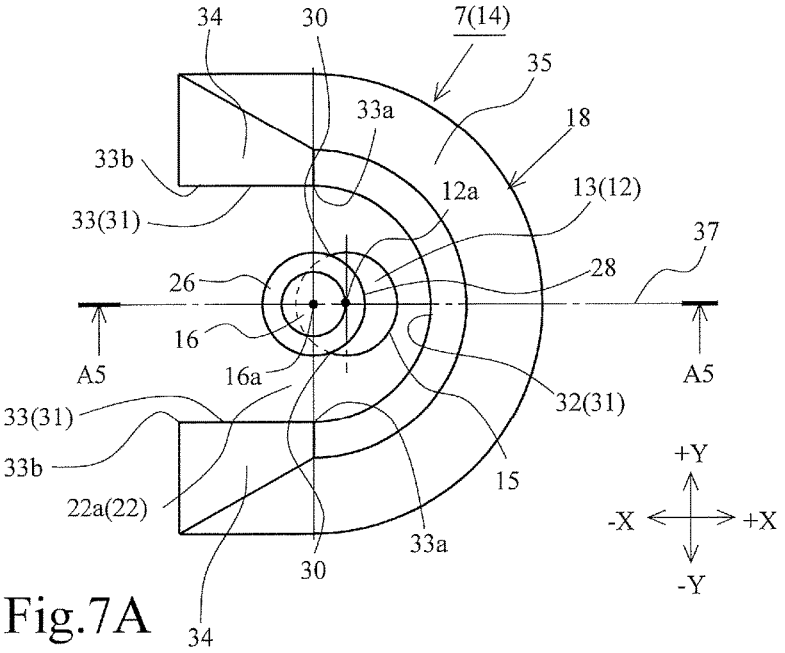
Figure 7B:
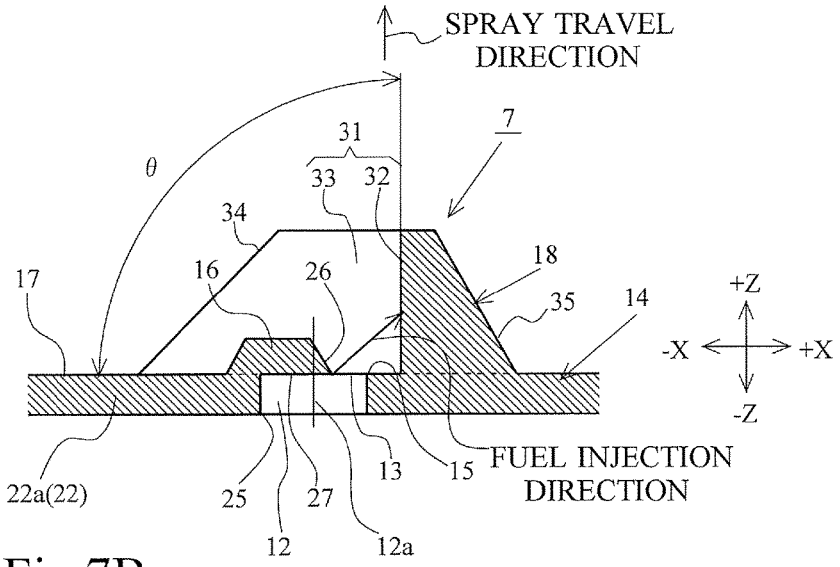

FIGS. 7A and 7B illustrate a part of the nozzle plate 7 according to the third embodiment of the invention, and illustrate a second modification of the nozzle plate 7 according to the first embodiment. In the nozzle plate 7 according to the embodiment, the same components as in the nozzle plate 7 according to the first embodiment are given the same reference numerals to eliminate the same descriptions as in the nozzle plate 7 according to the first embodiment.

In the nozzle plate 7 according to the embodiment, when the bottom wall part 22 (the thin-walled part 22*a*) is seen from the front side (in plan view), the first inner wall surface part 32 of the spray direction change element 18 is formed in a semicircle concentric with the center 16*a* of the interference body 16 and eccentric with respect to the center 12*a* of the nozzle hole 12 (i.e., the first inner wall surface part 32 and the nozzle hole 12 are not concentric). As illustrated in FIG. 7A, the first inner wall surface part 32 is closest to the outlet 15 of the nozzle hole 12 in the first center line 37 extending in the X-axis direction and the distance from the outlet 15 of the nozzle hole 12 increases with distance from the first center line 37 in the Y-axis direction.

The nozzle plate 7 according to the embodiment described above can make spray injected from the orifice 13 collide with the inner wall surface 31 of the spray direction change element 18 and change the travel direction of the spray having collided with the inner wall surface 31 of the spray direction change element 18 to the direction along the inner wall surface 31, so the same effects as in the nozzle plate 7 according to the first embodiment can be obtained.

Fourth Embodiment

Figure 8A:
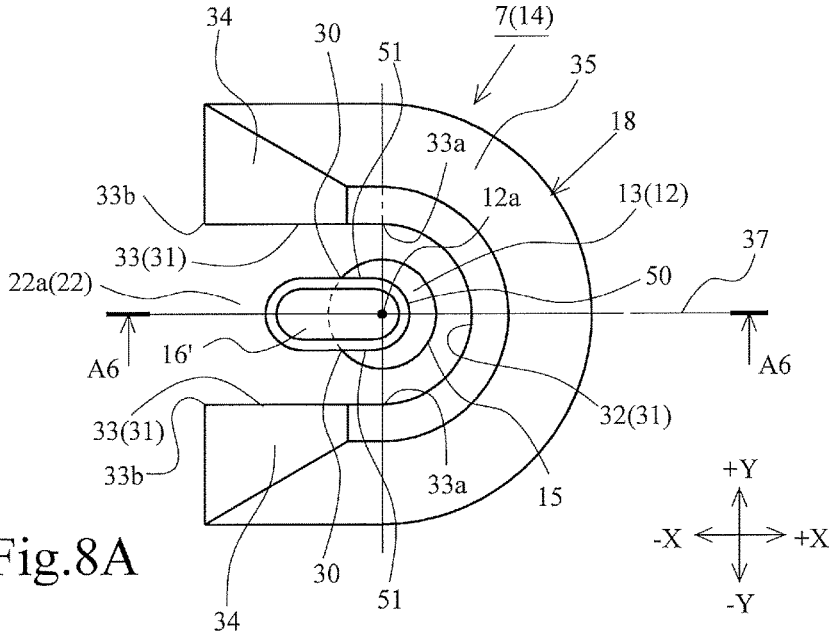
Figure 8B:
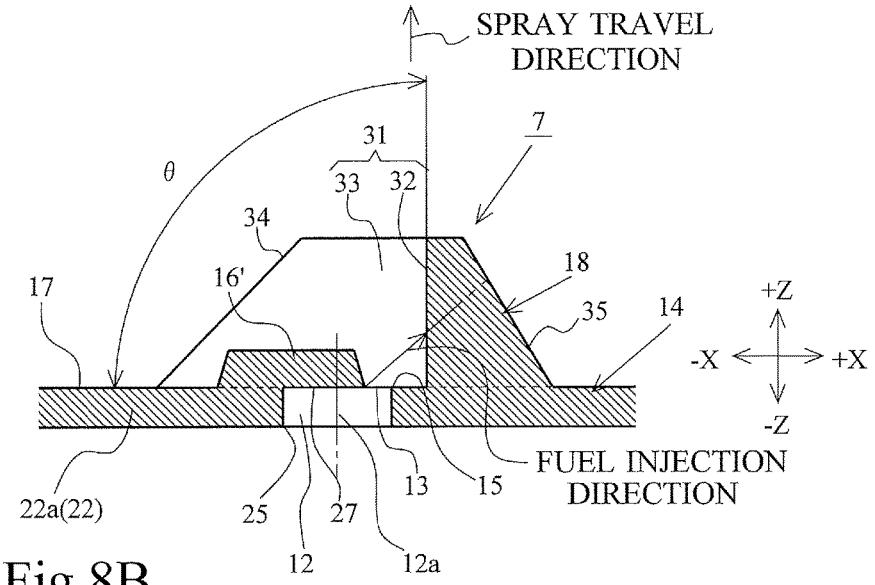

FIGS. 8A and 8B illustrate a part of the nozzle plate 7 according to the fourth embodiment of the invention, and illustrate a third modification of the nozzle plate 7 according to the first embodiment. In the nozzle plate 7 according to the embodiment, the same components as in the nozzle plate 7 according to the first embodiment are given the same reference numerals to eliminate the same descriptions as in the nozzle plate 7 according to the first embodiment.

In the nozzle plate 7 according to the embodiment, the shape of an interference body 16' differs from that of the interference body 16 of the nozzle plate 7 according to the first embodiment. That is, in the embodiment, the interference body 16' of the nozzle plate 7 is formed such that the oblong end portions in the longitudinal direction are formed in a semicircle in plan view (see FIG. 8A). In addition, the longitudinal direction of the interference body 16' is aligned with the first center line 37 connecting the centers 12*a* and 12*a* of the pair of nozzle holes 12 and 12 and the orifice 13 is formed by a semicircular outer edge part 50 on one end side, linear outer edge parts (outer edge parts) 51 and 51 connected to the semicircular outer edge part 50, and the circular outlet 15 of the nozzle hole 12. The corner portions 30 and 30 of the opening edge of the orifice 13 formed by the circular outlet 15 of the nozzle hole 12 and the linear outer edge parts 51 and 51 of the interference body 16' have an acute shape without roundness and can make the end parts of a liquid film of fuel passing through the corner portions 30 of the orifice 13 and their vicinity acute and sharp so that the fuel is easily atomized by friction with air.

The nozzle plate 7 according to the embodiment described above can make spray injected from the orifice 13 collide with the inner wall surface 31 of the spray direction change element 18 and change the travel direction of the spray having collided with the inner wall surface 31 of the spray direction change element 18 to the direction along the inner wall surface 31, so the same effects as in the nozzle plate 7 according to the first embodiment can be obtained.

Fifth Embodiment

Figure 9A:
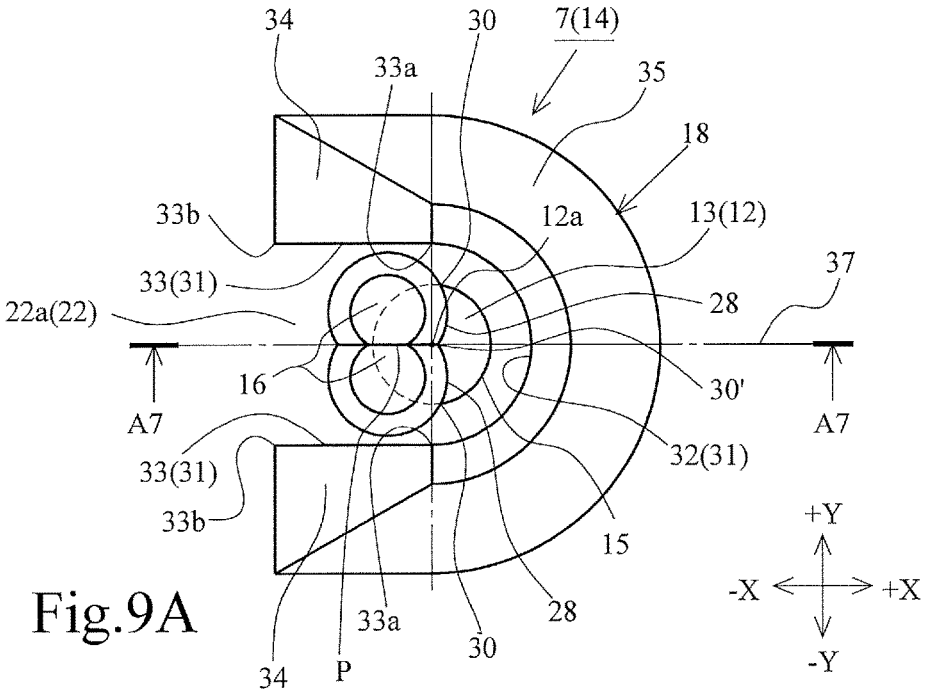
Figure 9B:
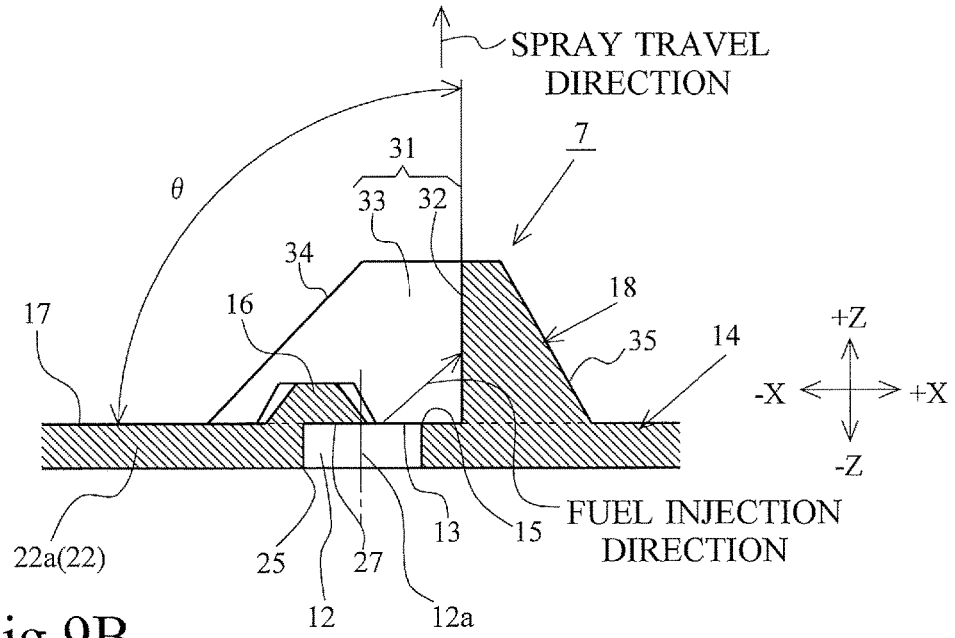

FIGS. 9A and 9B illustrate a part of the nozzle plate 7 according to the fifth embodiment of the invention, and illustrate a fourth modification of the nozzle plate 7 according to the first embodiment. In the nozzle plate 7 according to the embodiment, the same components as in the nozzle plate 7 according to the first embodiment are given the same reference numerals to eliminate the same descriptions as in the nozzle plate 7 according to the first embodiment.

In the nozzle plate 7 according to the embodiment, an abutment part P of the pair of interference bodies 16 and 16 is positioned in the first center line 37 passing through the center 12*a* of the nozzle hole 12, one end (corner portion 30') of the abutment part P of the pair of interference bodies 16 and 16 is positioned in the vicinity of the center 12*a* of the nozzle hole 12, and the other end of the abutment part P of the interference bodies 16 and 16 is positioned outside the nozzle hole 12. In addition, in the nozzle plate 7 according to the embodiment, the nozzle hole 12 is partially blocked by the pair of interference bodies 16 and 16, so that the substantially fan-shaped orifice 13 is formed by the circular outlet 15 of the nozzle hole 12 and the circular outer edge parts 28 and 28 of the pair of interference bodies 16 and 16. At the opening edge of the orifice 13, the corner portions 30 and 30 formed by the outlet 15 of the nozzle hole 12 and the circular outer edge parts 28 and 28 of the pair of interference bodies 16 and 16 and the corner portion 30' formed in the abutment part P of the pair of interference bodies 16 and 16. These corner portions 30 and 30' of the orifice 13 are formed in a sharp shape without roundness, the end part of a liquid film passing through the orifice 13 can be made thin, and the end part of a liquid film of fuel passing through the orifice 13 can be made acute and sharp, so that the fuel is easily atomized by friction with air.

The nozzle plate 7 according to the embodiment described above can make spray injected from the orifice 13 collide with the inner wall surface 31 of the spray direction change element 18 and change the travel direction of the spray having collided with the inner wall surface 31 of the spray direction change element 18 to the direction along the inner wall surface 31, so the same effects as in the nozzle plate 7 according to the first embodiment can be obtained.

Sixth Embodiment

Figure 10:
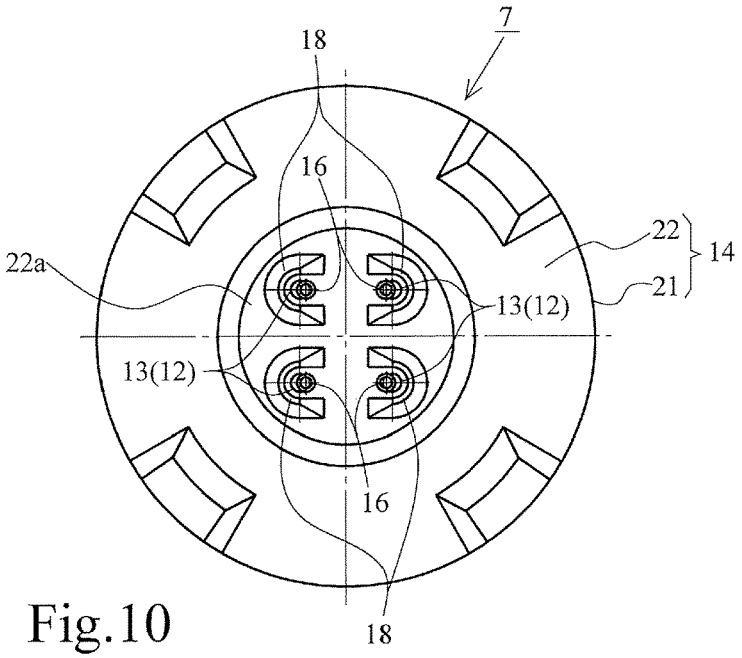
FIG. 10 is a front view illustrating a fuel injection device nozzle plate according to a sixth embodiment of the invention and this drawing corresponds to FIG. 3A.

As illustrated in FIG. 10, the nozzle plate 7 according to the invention is not limited to the nozzle plates 7 according to the above embodiments in which the two nozzle holes 12, the two interference bodies 16, and the two spray direction change elements 18 are formed. The nozzle plate 7 according to the invention may be provided with the four nozzle holes 12, the four interference bodies 16, and the four spray direction change elements 18 so as to spray fuel into one intake port 4 and the other intake port 4 of the 4-valve cylinder evenly.

Seventh Embodiment

Figure 11:
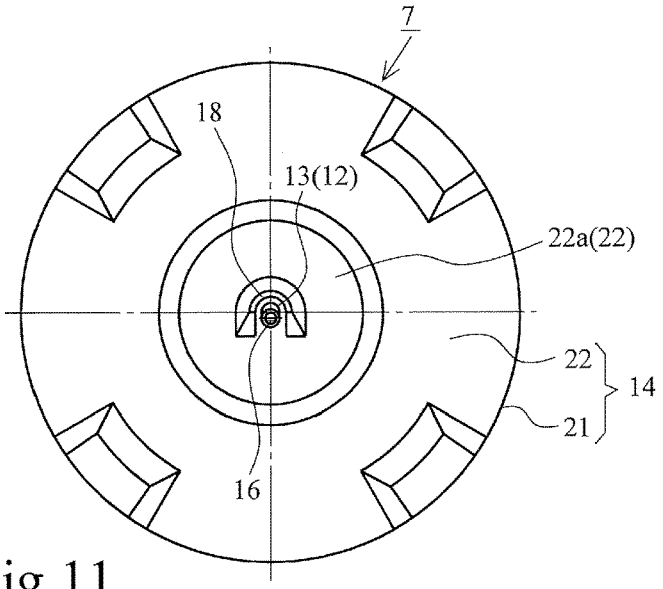
FIG. 11 is a front view illustrating a fuel injection device nozzle plate according to a seventh embodiment of the invention and this drawing corresponds to FIG. 3A.

In addition, as illustrated in FIG. 11, the nozzle plate 7 according to the invention is not limited to the nozzle plates 7 according to the above embodiments in which the two nozzle holes 12, the two interference bodies 16, and the two spray direction change elements 18 are formed. The nozzle plate 7 according to the invention may have the one nozzle hole 12, the one interference body 16, and the one spray direction change element 18 at the center of the thin-walled part 22*a* of the bottom wall part 22 so as to spray fuel into the intake port 4 of a 2-valve cylinder.

Eighth Embodiment

Figure 12A:
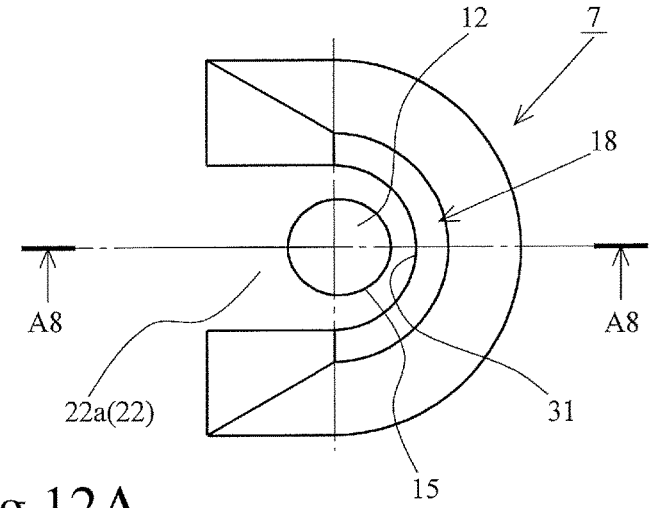
Figure 12B:
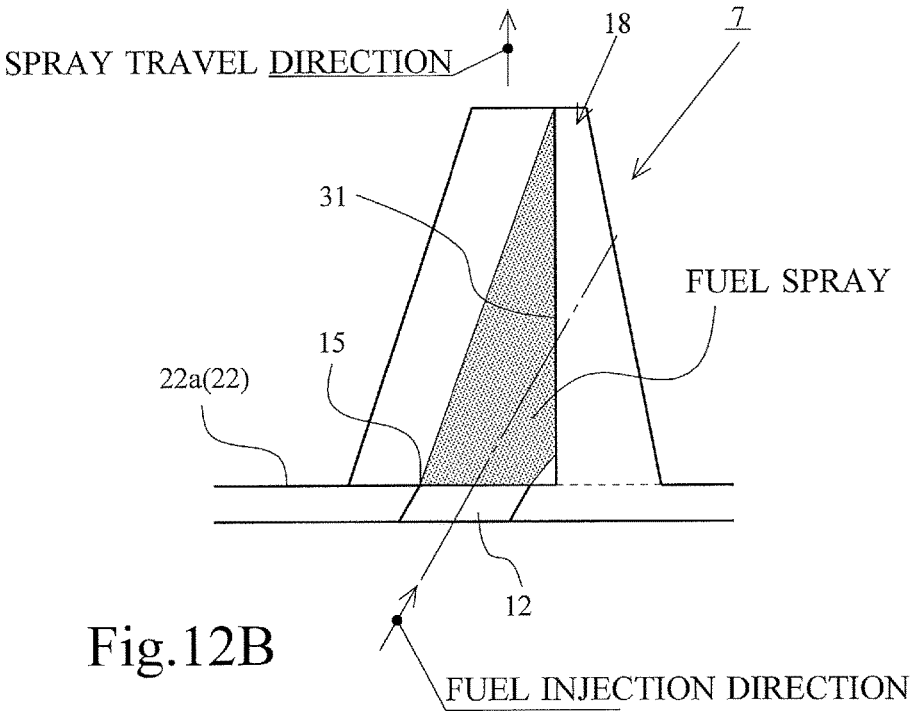
Figure 13A:
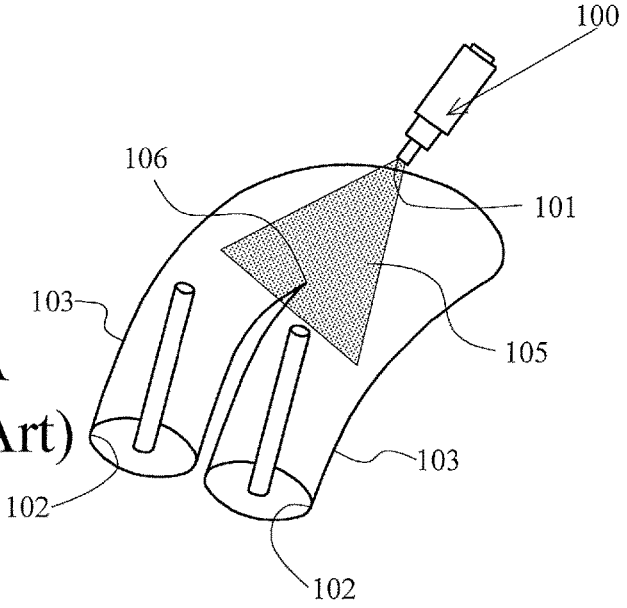
Fig.13A (Related Art)
Figure 13B:
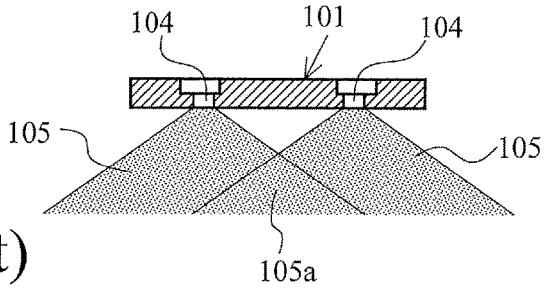
Fig.13B (Related Art)
FIG. 13B is a cross sectional view illustrating a nozzle plate used in the fuel injection device in FIG. 13A.
Figure 13C:
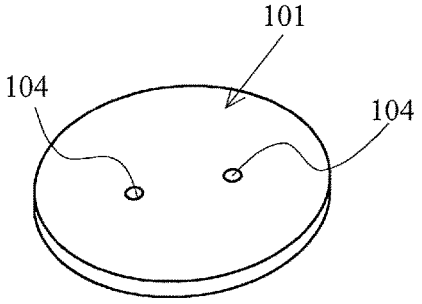
Fig.13C (Related Art)
FIG. 13C is a perspective view illustrating the appearance of the nozzle plate used in the fuel injection device in FIG. 13A.
Figure 14A:
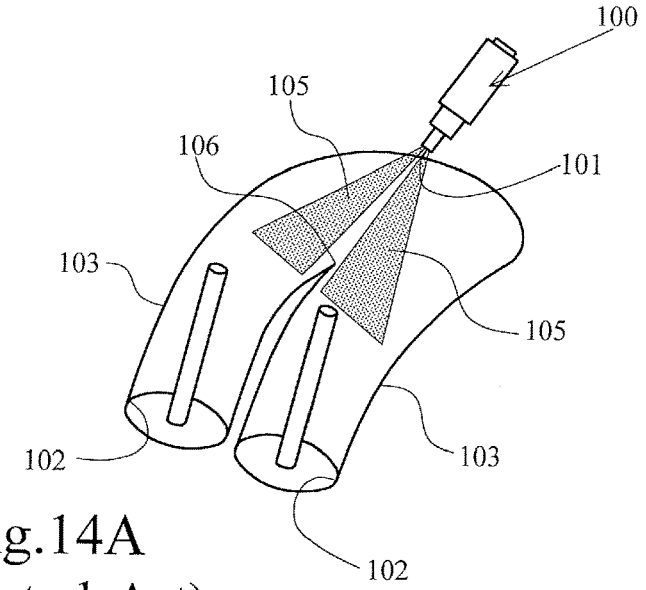
Fig.14A (Related Art)
Figure 14B:
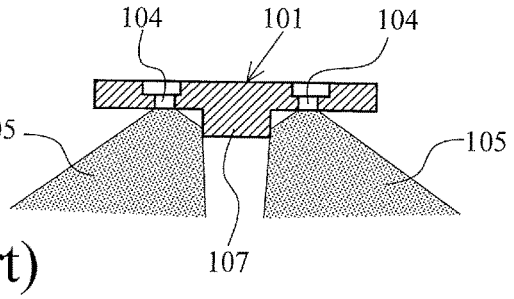
Fig.14B (Related Art)
Figure 14C:
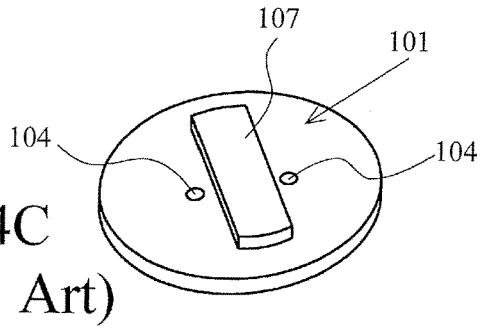
Fig.14C (Related Art)

In addition, as illustrated in FIG. 12, in the nozzle plate 7 according to the invention, the nozzle hole 12 may be formed obliquely so as to face the inner wall surface 31 of the spray direction change means 18, the interference bodies 16 and 16' partially blocking the outlet 15 of the nozzle hole 12 may be omitted, and fuel spray injected from the nozzle hole 12 may be made to collide with the inner wall surface 31 of the spray direction change element 18 to attempt to atomize droplets in the fuel spray, and the travel direction of the fuel spray may be changed according to the shape of the branching intake pipes 2 for a 4-valve cylinder and the position of the intake port 4.

Other Embodiments

Although not illustrated, the nozzle plate 7 according to the invention may include the three nozzle holes 12, the three interference bodies 16, and the three spray direction change elements 18 in the thin-walled part 22*a* of the bottom wall part 22 so as to correspond to a 5-valve cylinder.

In addition, although the nozzle plate 7 is made of synthetic resin in the above embodiments, the invention is not limited to the embodiments and the nozzle plate 7 may be formed using a metal injection mold method.

REFERENCE SIGNS LIST

1: fuel injection device
7: nozzle plate (fuel injection device nozzle plate)
8: fuel injection port
12: nozzle hole
14: nozzle plate main body
15: outlet
18: spray direction change means

The invention claimed is:

1. A fuel injection device nozzle plate to be attached to a fuel injection port of a fuel injection device, said nozzle plate comprising:

a nozzle plate main body;

a nozzle hole formed in the nozzle plate main body such that fuel injected from the fuel injection port passes through the nozzle plate;

a spray direction change element configured to collide with fuel spray injected from the nozzle hole so as to change a travel direction of the fuel spray, the spray direction change element being integrally formed with the nozzle plate main body so as to project around an outlet side of the nozzle hole extending through the nozzle plate main body; and an interference body partially blocking an outlet of the nozzle hole such that the nozzle hole injects fuel toward an inner wall surface of the spray direction change element;

wherein the inner wall surface of the spray direction change element is substantially U-shaped in plan view, and wherein the inner wall surface has a curved first inner wall surface part and a pair of second inner wall surface parts, the first inner wall surface part projecting so as to surround a part of the outlet side of the nozzle hole, the pair of second inner wall surface parts extending from both ends of the first inner wall surface part so as to face each other.

2. The fuel injection device nozzle plate according to claim 1, wherein the interference body has an inner surface blocking the outlet of the nozzle hole, the inner surface being co-planar with an outer surface of the nozzle plate main body.

3. The fuel injection device nozzle plate according to claim 1, wherein the outlet of the nozzle hole is formed as a circle in plan view, and the first inner wall surface part is formed as a semicircle in plan view, the semicircle being equidistant from an opening edge of the outlet of the nozzle hole.

4. The fuel injection device nozzle plate according to claim 3, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by an arc-shaped outer edge part of the interference body and the opening edge of the outlet of the nozzle hole, and the corner portion of the orifice being configured to form an end part of a liquid film of fuel passing though the orifice acute and sharp so that the fuel is atomized by friction with air.

5. The fuel injection device nozzle plate according to claim 3, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by a linear outer edge part of the interference body and the opening edge of the outlet of the nozzle hole, and the corner portion of the orifice being configured to form an end part of a liquid film of fuel passing though the orifice acute and sharp so that the fuel is atomized by friction with air.

6. The fuel injection device nozzle plate according to claim 1, wherein the outlet of the nozzle hole is formed as a circle in plan view, and the first inner wall surface part is formed as a semicircle in plan view, the semicircle being non-concentric with respect to the outlet of the nozzle hole.

7. The fuel injection device nozzle plate according to claim 6, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by an arc-shaped outer edge part of the interference body and the opening edge of the outlet of the nozzle hole, and the corner portion of the orifice being configured to form an end part of a liquid film of fuel passing though the orifice acute and sharp so that the fuel is atomized by friction with air.

8. The fuel injection device nozzle plate according to claim 6, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by a linear outer edge part of the interference body and the opening edge of the outlet of the nozzle hole, and the corner portion of the orifice being configured to form an end part of a liquid film of fuel passing though the orifice acute and sharp so that the fuel is atomized by friction with air.

9. The fuel injection device nozzle plate according to claim 1, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by an arc-shaped outer edge part of the interference body and the opening edge of the outlet of the nozzle hole, and the corner portion of the orifice being configured to make an end part of a liquid film of fuel passing though the orifice acute and sharp so that the fuel is atomized by friction with air.

10. The fuel injection device nozzle plate according to claim 1, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by a linear outer edge part of the interference body and the opening edge of the outlet of the nozzle hole, and the corner portion of the orifice being configured to make an end part of a liquid film of fuel passing though the orifice acute and sharp so that the fuel is atomized by friction with air.

11. A fuel injection device nozzle plate attached to a fuel injection port of a fuel injection device, said nozzle plate comprising:

a nozzle plate main body;

a nozzle hole formed in the nozzle plate main body such that fuel injected from the fuel injection port passes through the nozzle plate;

a spray direction change element configured to collide with fuel spray injected from the nozzle hole so as to change a travel direction of the fuel spray, the spray direction change element being integrally formed with the nozzle plate main body so as to project around an outlet side of the nozzle hole extending through the nozzle plate main body; and an interference body partially blocking an outlet of the nozzle hole such that the nozzle hole injects fuel toward an inner wall surface of the spray direction change element;

wherein the inner wall surface of the spray direction change element is substantially U-shaped in plan view, and wherein the inner wall surface has a curved first inner wall surface part and a pair of second inner wall surface parts, the first inner wall surface part projecting so as to surround a part of the outlet side of the nozzle hole, the pair of second inner wall surface parts extending from both ends of the first inner wall surface part so as to face each other.

12. The fuel injection device nozzle plate according to claim 11, wherein the interference body has an inner surface blocking the outlet of the nozzle hole, the inner surface being co-planar with an outer surface of the nozzle plate main body.

13. The fuel injection device nozzle plate according to claim 11, wherein the outlet of the nozzle hole is formed as a circle in plan view, and the first inner wall surface part is formed as a semicircle in plan view, the semicircle being equidistant from an opening edge of the outlet of the nozzle hole.

14. The fuel injection device nozzle plate according to claim 13, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by an arc-shaped outer edge part of the interference body and the opening edge of the outlet of the nozzle hole, and the corner portion of the orifice being configured to form an end part of a liquid film of fuel passing though the orifice acute and sharp so that the fuel is atomized by friction with air.

15. The fuel injection device nozzle plate according to claim 13, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by a linear outer edge part of the interference body and the opening edge of the outlet of the nozzle hole, and the corner portion of the orifice being configured to form an end part of a liquid film of fuel passing though the orifice acute and sharp so that the fuel is atomized by friction with air.

16. The fuel injection device nozzle plate according to claim 11, wherein the outlet of the nozzle hole is formed as a circle in plan view, and the first inner wall surface part is formed as a semicircle in plan view, the semicircle being non-concentric with respect to the outlet of the nozzle hole.

17. The fuel injection device nozzle plate according to claim 16, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by an arc-shaped outer edge part of the interference body and the opening edge of the outlet of the nozzle hole, and the corner portion of the orifice being configured to form an end part of a liquid film of fuel passing though the orifice acute and sharp so that the fuel is atomized by friction with air.

18. The fuel injection device nozzle plate according to claim 16, wherein the outlet of the nozzle hole is partially blocked by the interference body to form an orifice reducing a flow of fuel at the outlet, the nozzle plate main body, the spray direction change element, and the interference body are integrally formed by cooling and solidifying a molten material, a part of the orifice is provided with an acute and sharp corner portion without roundness, the corner portion being formed by a linear outer edge part of the interference body and the opening edge of the outlet of the nozzle hole, and the corner portion of the orifice being configured to form an end part of a liquid film of fuel passing though the orifice acute and sharp so that the fuel is atomized by friction with air.

* * * * *